US011333425B2

(12) United States Patent
Buter et al.

(10) Patent No.: US 11,333,425 B2
(45) Date of Patent: May 17, 2022

(54) FREEZER CABINET AND METHOD FOR ADAPTING A FREEZER CABINET

(71) Applicant: Conopco, Inc., Englewood Cliffs, NJ (US)

(72) Inventors: René Joachim Buter, Vlaardingen (NL); Johannes Krieg, Rotterdam (NL); Ashvinikumar Vishnukumar Mudaliar, Rotterdam (NL)

(73) Assignee: Conopco, Inc., Englewood Cliffs, NJ (US)

( * ) Notice: Subject to any disclaimer, the term of this patent is extended or adjusted under 35 U.S.C. 154(b) by 271 days.

(21) Appl. No.: 16/470,838

(22) PCT Filed: Dec. 7, 2017

(86) PCT No.: PCT/EP2017/081918

§ 371 (c)(1),
(2) Date: Jun. 18, 2019

(87) PCT Pub. No.: WO2018/114374

PCT Pub. Date: Jun. 28, 2018

(65) Prior Publication Data

US 2020/0088456 A1 Mar. 19, 2020

(30) Foreign Application Priority Data

Dec. 23, 2016 (EP) ..... 16206825

(51) Int. Cl.
*F25D 23/02* (2006.01)
*A47F 3/04* (2006.01)

(52) U.S. Cl.
CPC ..... *F25D 23/021* (2013.01); *A47F 3/043* (2013.01); *F25D 23/026* (2013.01); *F25D 23/028* (2013.01); *F25D 2400/10* (2013.01)

(58) Field of Classification Search
CPC .... F25D 23/021; F25D 23/026; F25D 23/028; F25D 2400/10; A47F 3/043; A47F 3/0434; A47F 3/0426
See application file for complete search history.

(56) References Cited

U.S. PATENT DOCUMENTS 2,569,763 A 10/1951 Hofferberth
2,619,804 A 2/1952 Widell
(Continued)

FOREIGN PATENT DOCUMENTS

AU 9703698 7/1999
CN 1112560 5/1994
(Continued)

OTHER PUBLICATIONS

Search Report and Written Opinion in PCTEP2017081918; dated Mar. 9, 2018: In F3730USw-NPL 1, pp. 1-13.
(Continued)

*Primary Examiner* — Joseph F Trpisovsky
(74) *Attorney, Agent, or Firm* — Gerard J. McGowan, Jr.

(57) ABSTRACT

A freezer cabinet (10) for storing frozen confectionery products, the freezer cabinet comprising: a chamber having an opening substantially sealed by an upper surface panel (18, 20); and a further panel (22, 24) inside the chamber being spaced away from the upper surface panel and substantially parallel to the upper surface panel in at least one direction and creating a quiescent region between the upper surface panel and further panel wherein the quiescent region is in gaseous communication with the air in the chamber. The upper surface panel comprises at least one slideably openable section (18, 20); the further panel comprises at least one slideably openable section (22, 24); and the chamber comprises a side wall (12, 14) and a coolant evaporator (40) mounted in and/or on the side wall. The height distance (H) between the further panel, measured from the lowest
(Continued)

face of the further panel facing the chamber, and the highest part of the evaporator is at least 5 mm.

9 Claims, 4 Drawing Sheets

(56) References Cited

U.S. PATENT DOCUMENTS

| | | | | |
|---|---|---|---|---|
| 5,947,197 | A * | 9/1999 | Lee | A23B 7/10 165/206 |
| 6,247,773 | B1 | 6/2001 | Harigai | |
| 2013/0008090 | A1 | 1/2013 | Lanzl | |
| 2016/0348956 | A1 | 12/2016 | Toschek | |
| 2017/0027338 | A1 | 2/2017 | Resch | |

FOREIGN PATENT DOCUMENTS

| | | |
|---|---|---|
| CN | 2164532 | 5/1994 |
| CN | 1219673 | 6/1999 |
| CN | 1233737 | 11/1999 |
| DE | 4205881 | 9/1893 |
| DE | 202006008384 | 7/2006 |
| DE | 102009031278 | 1/2010 |
| DE | 202014101651 | 5/2014 |
| EP | 1103544 | 5/2001 |
| JP | 4718856 | 11/1972 |
| JP | 57116164 | 7/1982 |
| JP | H10253236 | 9/1998 |
| JP | 11264652 | 9/1999 |
| KR | 20050103722 | 11/2005 |
| KR | 20110080523 | 7/2011 |
| PH | 1199900566 | 10/2007 |
| WO | WO9822006 | 5/1998 |
| WO | WO12066429 | 5/2012 |

OTHER PUBLICATIONS

Search Report and Written Opinion in EP16206825; dated Jun. 21, 2017. In F3730USw-NPL 2, pp. 14-21.

Search Report and Written Opinion in EP16206826; dated Jun. 19, 2017. In F3730USw-NPL 3, pp. 22-43.

Search Report and Written Opinion in PCTEP2017081826; dated Mar. 9, 2018; In F3730USw-NPL 4, pp. 44-57.

Written Opinion in PCTEP2017081826; dated Nov. 6, 2018; In F3730USw-NPL 5, pp. 58-65.

IPRP in PCTEP2017081826; Apr. 2, 2019; In F3730USw-NPL 6, pp. 66-74.

Co-pending Application: Applicant: Buter et al., Filed: Jun. 18, 2019.

* cited by examiner

FREEZER CABINET AND METHOD FOR ADAPTING A FREEZER CABINET

TECHNICAL FIELD

The present invention relates to a freezer cabinet and method for adapting a freezer cabinet for containing frozen confectionery products.

BACKGROUND OF THE INVENTION

Retail outlets for frozen confectionery typically store the frozen confectionery in a freezer cabinet. Such freezers are essentially the same as domestic freezer appliances, having a chamber in which the frozen confectionery is stored, in which the temperature is maintained by refrigeration apparatus.

Most frozen confectionery products are to be stored within narrow temperature ranges, in order to maintain product quality. However, one drawback of such freezer cabinets is that they tend to suffer from large temperature gradients. Such temperature gradients are established due to the fact that warm air is less dense than cold air and also because the majority of the heat ingress occurs through the upper surface of the chamber, as the walls and base are typically thermally insulated.

Often this temperature gradient is merely tolerated and large temperature differences can exist between the average product temperature and the refrigerant to compensate for heat entering the cabinet through the upper surface. Further, in order to ensure that the maximum allowable product temperature is not breached, the refrigeration temperature needs to be set much lower than the temperature of the products, especially those products in the upper regions of the freezer chamber.

Japanese laid open utility model publication 57-116,164 U relates to showcases equipped with a sliding door.

Japanese laid open utility model publication 47-018,856 U relates to refrigerating showcases.

Japanese laid open utility model publication 57-090,675 U relates to showcases equipped with a sliding door.

Japanese patent application publication JP 11-264652 A relates to a low-temperature showcase using a see-through door.

U.S. Pat. No. 2,619,804 relates to refrigerators and is particularly concerned with maintaining a storage space of a refrigerator at a low temperature.

The present inventors have found that providing a freezer cabinet having a specific configuration of panels can provide certain advantages.

SUMMARY OF THE INVENTION

In a first aspect the invention relates to a freezer cabinet for storing frozen confectionery products, the freezer cabinet comprising:

- a chamber having an opening substantially sealed by an upper surface panel; and
- a further panel inside the chamber being spaced away from the upper surface panel and substantially parallel to the upper surface panel in at least one direction and creating a quiescent region between the upper surface panel and further panel wherein the quiescent region is in gaseous communication with the air in the chamber;

wherein:

- at least part of the upper surface panel and further panel is transparent such that at least part of the inside of the chamber is visible through the upper surface panel and further panel;
- the upper surface panel comprises at least one slideably openable section;
- the further panel comprises at least one slideably openable section; and
- the chamber comprises a side wall and a coolant evaporator mounted in and/or on the side wall; and
- the height distance (H) between the further panel, measured from the lowest face of the further panel facing the chamber, and the highest part of the evaporator is at least 5 mm.

The presence of the further panel serves to provide a layer of quiescent air between the upper surface panel and further panel, although the air between the two panels is in gaseous communication with the remainder of the air in the storage chamber even when both panels are closed.

Thus the further panel has the effect of the quiescent region mixing much less with the cold air below this quiescent region. The reduction in mixing means that the quiescent region becomes warmer than it would without the presence of the further panel. Thus the temperature difference between the upper quiescent region in contact with the upper surface panel of the freezer and the ambient temperature of the surroundings of the freezer is therefore reduced which results in a reduced heat transfer rate through the upper surface panel and therefore into the freezer chamber.

The reduced heat transfer rate means that the thermal load on the freezer is reduced. This means that the freezer can operate at a lower power requirement for a given maximum product temperature and also can provide a reduced thermal gradient as less heat is flowing into the chamber.

Without wishing to be bound by theory, the improved thermal properties from the presence of the further panel are believed to arise from the quiescent air region between the two panels rather than the thermal insulating properties of the further panel.

As used herein, where two entities are specified to be "substantially parallel" in a given direction, this means that the entities extend in said direction within 20 degrees of parallel, more preferably within 10 degrees, more preferably still within 5 degrees and most preferably from 0 to 2 degrees of parallel.

The further panel is preferably substantially parallel to the upper surface panel in at least one horizontal direction. More preferably the direction is the direction in which the openable section in the further panel is slideable. Most preferably the further panel is substantially parallel to the upper surface panel in both horizontal directions.

Several types of refrigeration system are known in the art. Known systems include, for example, forced-air systems where air is forced over a cooling element in order to cool the air and then the cooled air is forcefully circulated around the chamber. The air is moved over the cooling element and/or around the chamber with the use of one or more fans. Another type of system is more passive and relies on a coolant evaporator mounted in and/or on the side wall of the chamber. Where the evaporator is mounted within the side walls it typically comprises tubes coiling around the side walls and is commonly referred to as a "skin evaporator" (such tubes may or may not be mounted on metal plates). Where the evaporator is mounted on the wall it typically comprises one or more metal plates which are shaped to contain channels for the coolant and is commonly referred to as a "roll-bond evaporator". In the present invention the refrigeration system comprises a coolant evaporator mounted in and/or on the side wall of the chamber, as these systems do not disturb the quiescent layer. It is preferred that the cabinet does not comprise a forced-air cooling system.

The present inventors have found that where a coolant evaporator is mounted in and/or on the side wall, the positioning of the further panel with respect to the evaporator can influence the effectiveness of the further panel in reducing the thermal load on the freezer. In particular if the height distance (H) between the further panel, measured from the lowest face of the further panel facing the chamber, and the highest part of the evaporator is increased then the effectiveness of the further panel is increased.

The height distance (H) is thus at least 5 mm, preferably at least 7 mm, more preferably at least 8 mm and most preferably at least 10 mm. Preferably the further panel is not too high above the evaporator as this can reduce the size of the quiescent layer. Thus it is preferred that H is no more than 100 mm, more preferably no more than 80 mm, more preferably still no more than 70 mm, even more preferably no more than 60 mm and most preferably no more than 50 mm.

An additional way of ensuring that the quiescent layer does not become too small is to ensure that the sum of the thickness of the upper surface panel and the further panel is less than 90% of the height thickness of the upper surface panel, quiescent region and further panel. The thickness of the upper surface panel, and likewise for the further panel, is defined as the distance between the upper most surface facing away from the freezer chamber and lower most surface facing towards the freezer chamber of the panel. The height thickness is defined as the distance between the upper most surface facing away from the freezer chamber of upper surface panel and the lower most surface facing towards the freezer chamber of the further panel.

More preferably the sum of the thickness of the upper surface panel and the further panel is less than 80%, even more preferable less than 70%, still more preferably less than 60% and most preferably from 10 to 50% of the height thickness.

The present inventors have also found that by limiting the amount of surface area of the opening covered by the further panel, the formation of condensation on the further panel can be reduced or even eliminated, thus allowing excellent visibility of the products in the chamber. In the present specification it should be understood that that the amount of the surface area of the opening covered by the further panel refers to the surface area of the opening in a horizontal plane at a height of the lowest part of the further panel.

Preferably the further panel covers less than 95% of the surface area of the opening, more preferably less than 92%, even more preferably less than 90%, more preferably still less than 89% and most preferably less than 88%.

To avoid the air in the quiescent region mixing too much with the air in the chamber, it is preferred that the further panel covers at least 50% of the surface area of the opening, more preferably at least 60%, more preferably still at least 70% and most preferably at least 80%.

Where the further panel does not completely cover the opening, the space in the opening that is not covered by the further panel is conveniently formed by at least one gap between at least one edge of the further panel and at least one inner surface of the sidewall delimiting the chamber wherein the inner surface faces the chamber. Preferably the cabinet comprises at least two such gaps with each gap being at opposite ends of the further panel. Most preferably there is a continuous gap surrounding the entire further panel. Additionally or alternatively the space in the opening that is not covered by the further panel may be formed by one or more holes and/or recesses in the further panel.

The chamber is typically delimited by the side wall (plus additional side walls if required), a base and the upper surface panel. In a typical arrangement the chamber has a rectangular base but other configurations such as, for example, a circular base are possible.

It is also common for the chamber to comprise baskets, which contain the frozen confectionery products and prevent them contacting the cold walls of the chamber, more preferably the chamber comprises removable baskets.

The upper surface panel and the further panel both comprise at least one slideably openable section to allow easier access to the frozen confectionery products in the freezer. Preferably the upper surface panel and the further panel both comprise two slideably openable sections. Typically each openable section will not take up the entirety of the panel, but for example half of the total surface of the upper surface panel and half of the total surface area of the further panel.

Preferably each of the slideably openable sections in the upper surface panel is aligned with the corresponding slideably openable section in the further panel such that when moved parallel to one another an opening in each panel is created of about the same surface area.

Preferably the slideably openable sections in the upper surface panel have about the same shape as the slideably openable sections in the further panel. The slideably openable sections in the further panel are typically of a different dimension to those of the upper surface panel, preferably the slideably openable sections in the further panel are smaller (i.e. cover a smaller surface area of the opening) than those of the upper surface panel.

Preferably the slideably openable sections make up the entirety of the upper surface panel and the further panel.

As discussed above, the gas in the quiescent region remains in gaseous communication with the air in the storage chamber. Thus the mere presence of the substantially parallel upper surface panel and further panel provides sufficient entrapment of the gas between them, without requiring entrapment of the gas at the edges of the panels. It has been found that the absence of a sealing frame all around the edges of the panels for the entrapment of gas (as for example present in a double glazed window) provides for less air turbulence, and therefore better energy performance, when the freezer cabinet is opened and also eliminates thermal conduction through the sealing frame.

However, it is preferable that each of the slideably openable sections in the upper surface panel is attached to the corresponding slideably openable section in the further panel such that the slideably openable section in the further panel remains unmoved relative to the slideably openable section in the upper surface panel when the latter is opened and closed. This can be achieved for example by struts, brackets or side panels connecting the corresponding slideably openable sections together and fixing the distance they are spaced apart from each other.

Preferably each of the slideably openable sections slides just under or above the remainder of the corresponding upper surface panel or further panel. It will be understood that if more than one slideably openable section is present in each of the upper surface panel and further panel the remaining portion of the panel is also preferably a slideably openable section.

At least part of the upper surface panel and further panel is transparent thereby serving as a viewing window, so that the consumer can view the frozen confectionery products before opening the slideably openable sections to remove the chosen product. Preferably the entire upper surface panel and further panel of the freezer are transparent to enable as many stored confectionery products to be viewable as possible without opening the openable sections. It will be understood that a frame, if present, to support the upper surface panel and/or further panel does not have to be transparent for the entire upper surface panel and further panel of the freezer to be transparent.

Preferably at least part of the upper surface panel is made from glass, plastic or a combination thereof. Glass is preferred as the upper surface panel is exposed to the outside and more vulnerable for wear and tear like e.g. scratching.

Preferably at least part of the further panel is made from glass, plastic or a combination thereof. Glass is preferred.

The upper surface panel and/or further panel can comprise a low emissivity coating to further enhance the thermal insulation provided by the panels. This is especially preferred when both panels are transparent. It is therefore preferred that the upper surface panel and further panel comprise a low emissivity coating.

For a typical ice-cream product freezer the maximum tolerable product temperature is −18° C. Thus the temperature at the upper end of the chamber is typically from −20 to −18° C. At the lower end of the chamber the temperature is typically from −26 to −24° C.

The temperature gradient in the freezer cabinet is preferably such that the difference in average product temperature between the upper end of the chamber and the lower end of the chamber is less than 6° C., more preferably less than 5° C., even more preferably less than 4° C., or even between 0 and 3° C.

Benefits of the invention in power consumption reduction and/or vertical temperature gradient reduction within the storage chamber and/or condensation reduction are also applicable in freezers where the set points are between −5° C. and −30° C., and even more preferably between −8° C. and −25° C. Such set points e.g. can be preferred for different types of food products.

It will be appreciated that the freezer cabinet of the invention is especially suitable for environmental conditions (i.e. external conditions) in which the freezer has to operate in temperatures of more than 30° C., i.e. higher than Climate Class 4.

The invention further provides for a method of providing a freezer cabinet according to the invention as described in any embodiment of the first aspect above, the method involving providing an existing freezer cabinet comprising the chamber having the opening substantially sealed by the upper surface panel; and installing the further panel inside the chamber in an arrangement substantially parallel to but spaced away from the upper surface panel. Adding the further panel creates a quiescent region between the upper surface panel and further panel wherein the quiescent region is in gaseous communication with the air in the chamber.

The method of the present invention can be applied to existing freezer cabinets from which frozen confectionery products are commonly sold from retail outlets. Thus, substantial power consumption savings can be obtained without requiring wholesale replacement of existing freezers in use or increasing condensation that reduces visibility of products in such freezer cabinets.

BRIEF DESCRIPTION OF THE DRAWINGS

The invention will now be illustrated by way of example and with reference to the following figures, in which.

DETAILED DESCRIPTION

Figure 1:
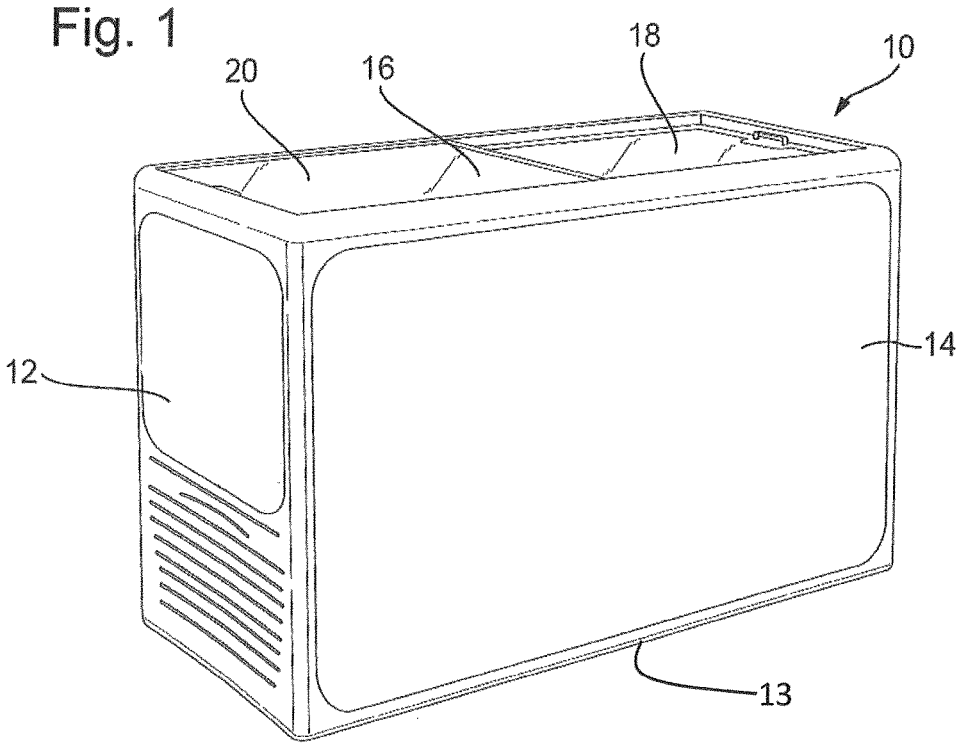
FIG. 1 is a perspective view of a freezer cabinet according to an embodiment of the invention.

FIG. 1 shows an external view of a freezer cabinet (10) with a rectangular base (13), such as a Nucab VT300 freezer cabinet—Rio H 125G, 291 litres.

The rectangular base (13) along with side walls (12, 14) and an upper surface (16) delimit the chamber in which frozen confections, such as ice cream, are stored and displayed. The upper surface (16) is split into two halves made up of a lower slideably openable section (18) which slides just under an upper section (20) of the upper surface. The upper section (20) also acts as a slideably openable section and can slide over the lower section (18). Both sections (18, 20) are each made of a single sheet of reinforced glass.

Unlike a typical cabinet, the cabinet in FIG. 1 is modified by introducing a further panel comprising two sections (22, 24) parallel to and spaced apart from both the lower openable section (18) and upper openable section (20) of the upper surface respectively. The further panels are also conveniently formed of glass.

Figure 2:
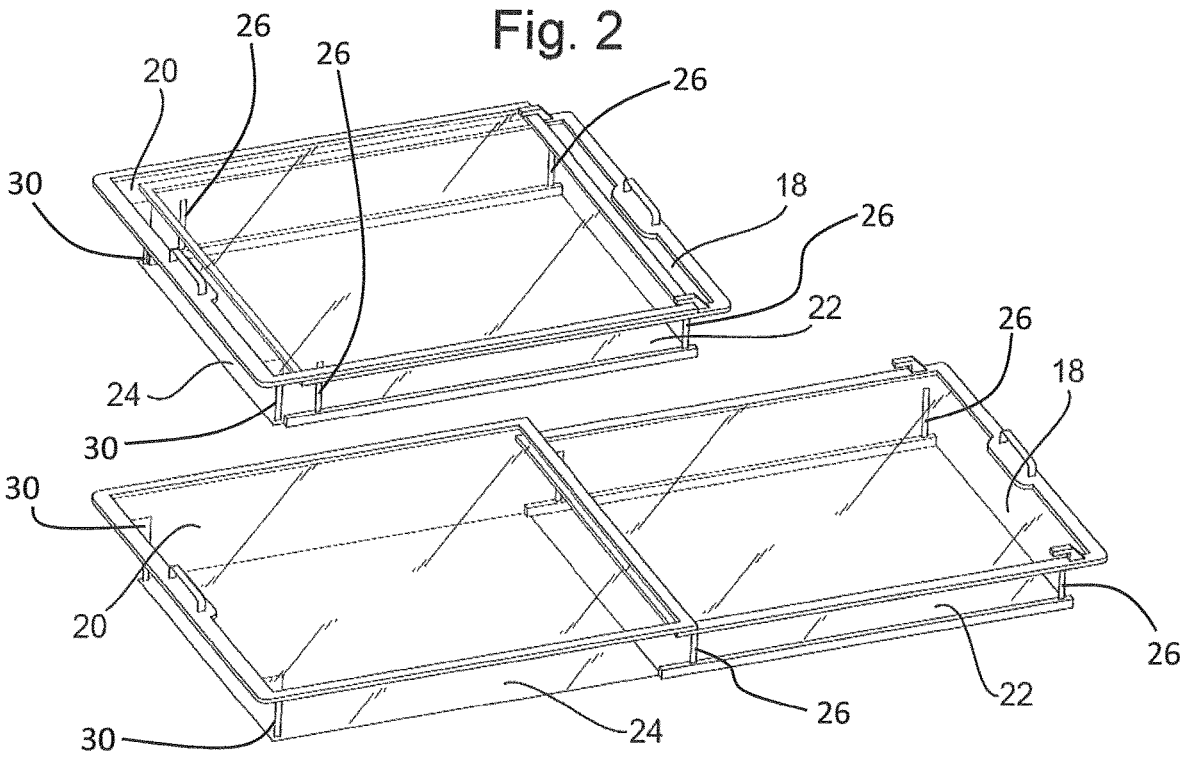
FIG. 2 is a perspective view of the upper surface panel and the further panel of the freezer cabinet shown in FIG. 1, in both an open (top drawing) and closed (bottom drawing) state.

As can be seen in FIG. 2, not only does the lower openable section (18) slide just under the upper openable section (20) of the upper surface (16) but further section (22) also slides just above the other further section (24). When the opening is closed, there exists a quiescent region of air between the upper surface (16) and the further sections (22, 24).

The further section (22) is fitted by attaching it by struts (26) to the lower openable section (18) of the upper surface (16). In this way further panel (22) can be slideably moved together with lower openable section (18). In a similar manner the other further panel (24) is attached to upper openable section (20) by struts (30). Therefore the sections are openable by sliding across without disturbing most of the air in quiescent region. Additionally the spacing of the further panels (22, 24) from the upper surface (16) could be modified by modifying the height of the struts (26) and (30).

Figure 3:
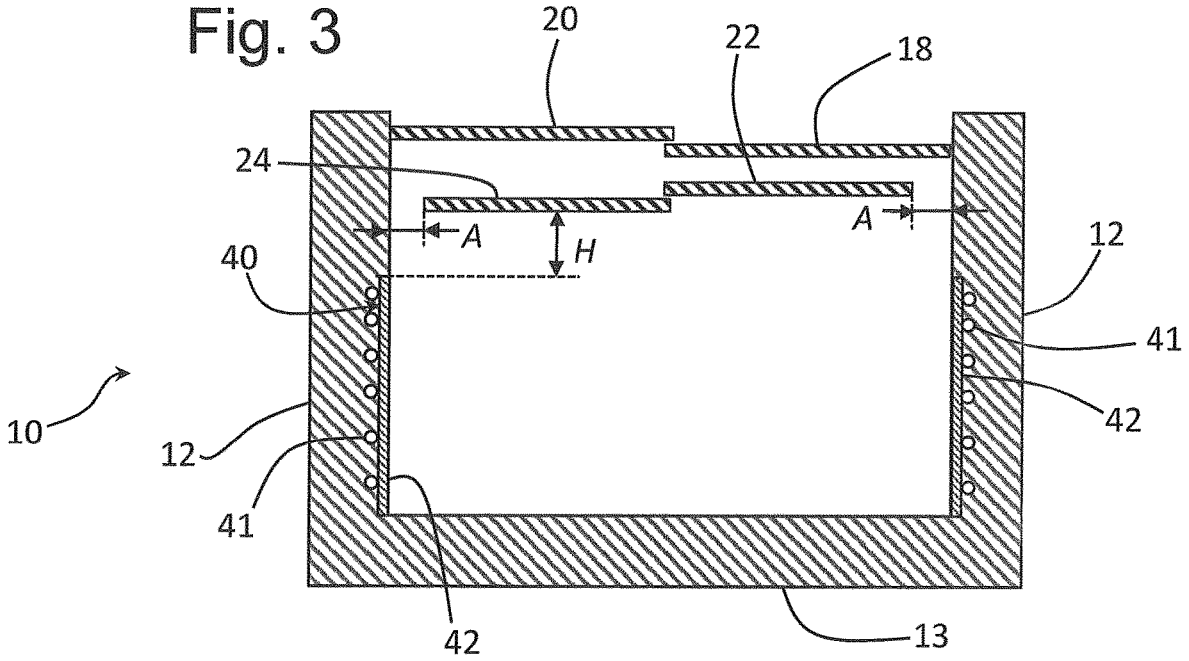
FIG. 3 shows a schematic cross-section of the freezer cabinet of FIG. 1 and equipped with a skin evaporator.
Figure 4:
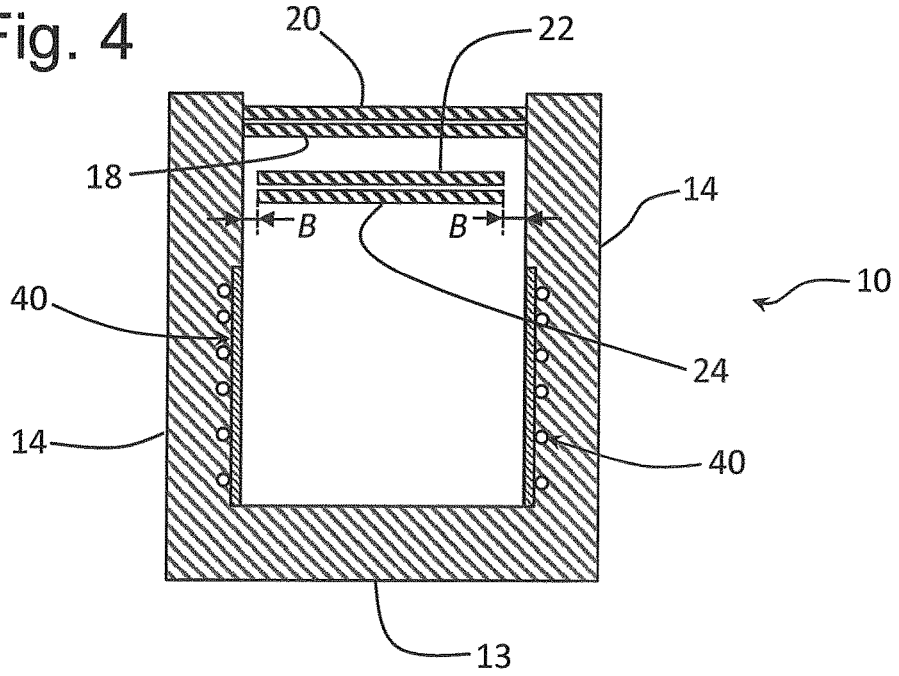
FIG. 4 shows a schematic cross-section of the freezer cabinet of FIG. 3 in an orthogonal direction to the section of FIG. 3.

In FIGS. 3 and 4 the cabinet is shown equipped with a skin evaporator (40) which comprises evaporator tubes (41) mounted on metal plates (42) and coiled around and embedded in the sidewalls (12, 14). The compressor/condensor and associated equipment are omitted from FIGS. 3 and 4 for clarity.

As can be seen in FIGS. 3 and 4, the further sections (22, 24) do not cover the entire opening of the chamber. There is a continuous gap between the further sections (22, 24) and the inner surface of the sidewalls (12, 14). The further sections (22, 24) are spaced away from the two narrowest sidewalls (12) by a distance (A) and from the widest sidewalls (14) by a distance (B). The spacings (A) and (B) are selected in order that the further sections (22, 24) cover less than 95% of the surface area of the opening. Owing to the gap formed by this spacing, moisture does not become trapped in the quiescent region and can migrate to and freeze on the very cold sections of the sidewalls (12, 14) in contact with the evaporator (40). This prevents or at least reduces the amount of condensation on the further sections (22, 24) which would otherwise reduce product visibility.

As can also be seen in FIGS. 3 and 4, the lowest further panel (24) is located above the top of the evaporator (40) by a height distance (H). The top of the evaporator (40) is the top edge of the metal plate (42) on which the tubes (41) are mounted and in thermal contact. By ensuring the height distance (H) is at least 5 mm, cooling of the quiescent region can be reduced such that the air in the quiescent region maintains its thermal barrier properties. This reduces the thermal load on the freezer and also reduces the risk of condensation which would occur more readily if the further sections (22, 24) were very cold.

Figure 5:
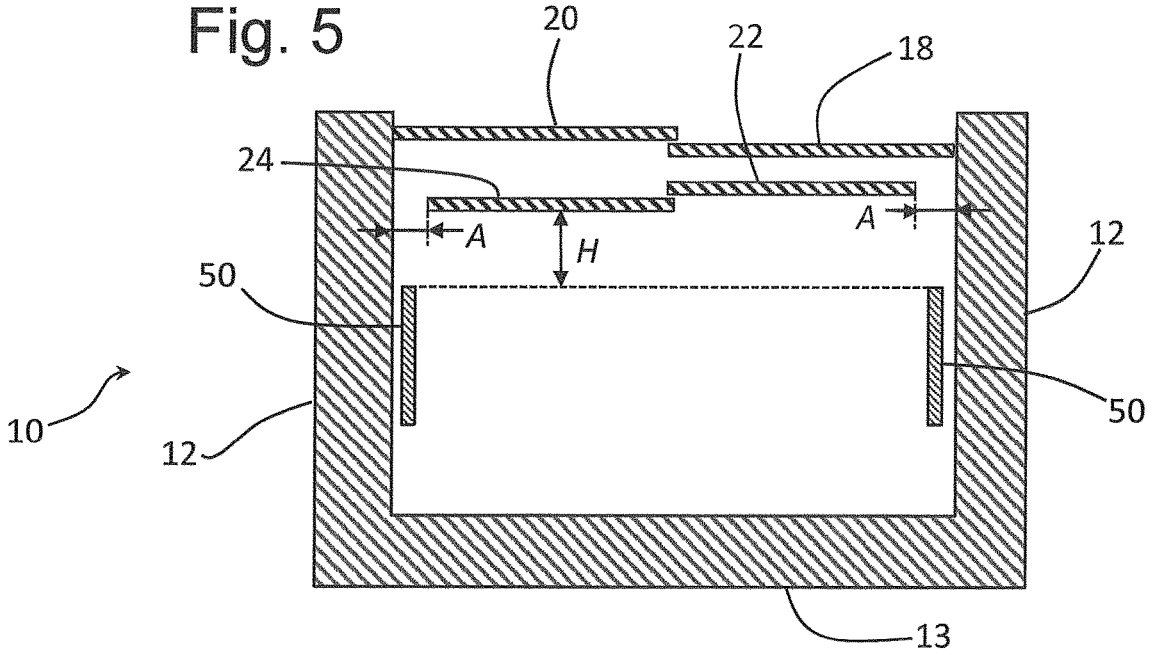
FIG. 5 shows a schematic cross-sectional view of the freezer cabinet of FIG. 1 and equipped with a roll-bond evaporator.
Figure 6:
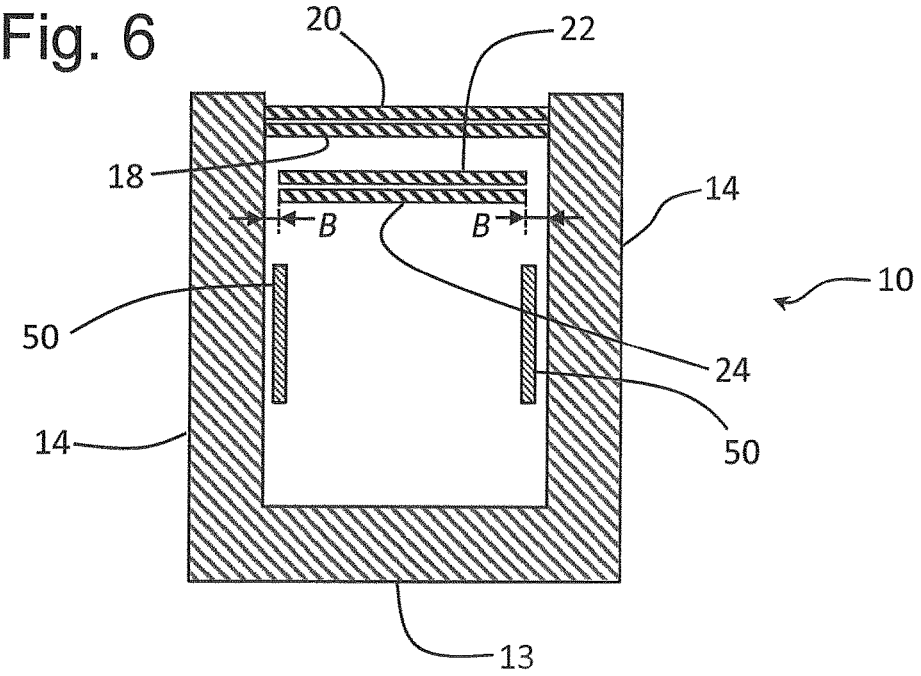
FIG. 6 shows a schematic cross-section of the freezer cabinet of FIG. 5 in an orthogonal direction to the section of FIG. 5.

FIGS. 5 and 6 show a similar arrangement to that in FIGS. 3 and 4 except that the skin evaporator (40) is replaced by a roll-bond evaporator (50) mounted on the sidewalls (12, 14).

Figure 7:
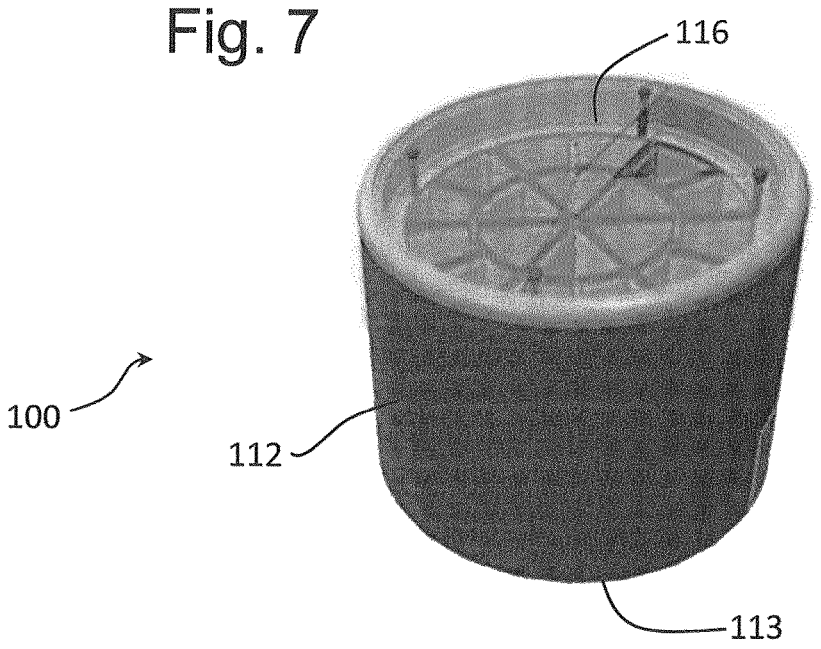
FIG. 7 is a perspective view of a freezer cabinet according to another embodiment of the invention.

FIG. 7 shows an external view of another freezer cabinet (100) but this time with a circular base (113). The circular base (113) along with single wall (112) and an upper surface (116) delimit the chamber in which frozen confections, such as ice cream, are stored and displayed. The advantage of employing a freezer with a circular base is reduced heat loss owing to a low surface area for a given volume.

Figure 8:
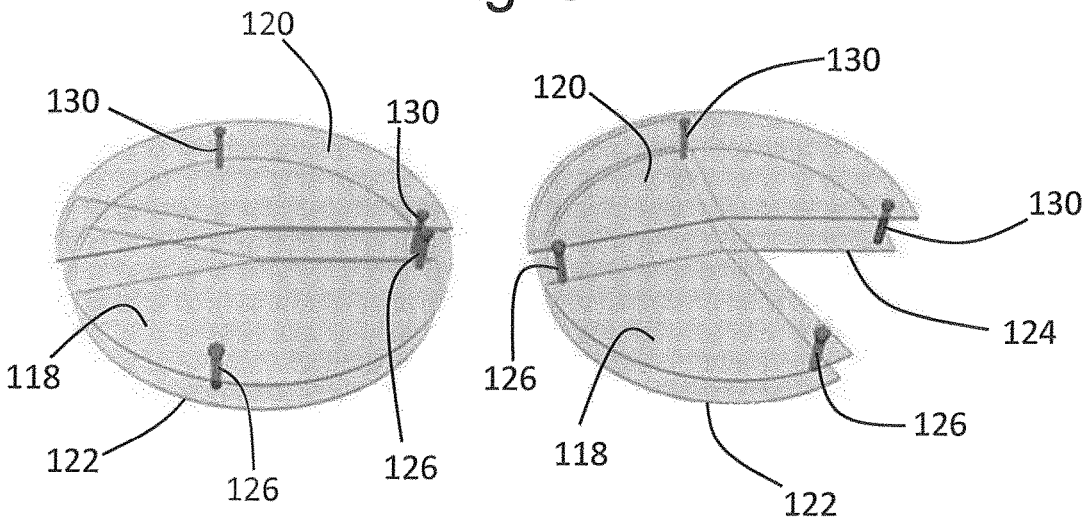
FIG. 8 is a perspective view of the upper surface panel and the further panel of the freezer cabinet shown in FIG. 7, in both an open (right-hand drawing) and closed (left-hand drawing) state.

As best seen in FIG. 8, the upper surface (116) is split into two halves made up of a lower slideably openable section (118) which slides just under an upper section (120) of the upper surface. The upper section (120) also acts as a slideably openable section and can slide over the lower section (118).

Whereas the slideably openable sections (18, 20) of the rectangular cabinet shown in FIGS. 1 to 6 slide by translating along a linear path, the slideably openable sections (118, 120) of the embodiment in FIGS. 7 and 8, slide along a circular path about an axis passing vertically through the centre of the upper surface (116).

The cabinet in FIG. 7 is modified by introducing a further panel comprising two sections (122, 124) parallel to and spaced apart from both the lower openable section (118) and upper openable section (120) of the upper surface respectively.

As can be seen in FIG. 8, not only does the lower openable section (118) slide just under the upper openable section (120) of the upper surface (116) but further section (122) also slides just above the other further section (124). When the opening is closed, there exists a quiescent region of air between the upper surface (116) and the further sections (122, 124).

The further section (122) is fitted by attaching it by struts (126) to the lower openable section (118) of the upper surface (116). In this way further panel (122) can be slideably moved together with lower openable section (118). In a similar manner the other further panel (124) is attached to upper openable section (120) by struts (130). Therefore the sections are openable by sliding around without disturbing most of the air in quiescent region.

EXAMPLES

Experiments were carried out on either an AHT VT300 freezer cabinet (Rio H 125G, 291 litres) modified as shown in FIGS. 1 to 4 or a custom-built freezer cabinet employing a roll-bond evaporator similar to that described in FIGS. 5 and 6. The upper panel was formed of two glass sections, each 4 mm thick. The further panel sections were also formed of 4 mm thick glass. Low emissivity coating was applied to both the upper and lower panels Control experiments were also performed without the presence of the further panel sections.

The experiments were performed in a controlled environmental chamber (Climate Class 4). Each cabinet was allowed to reach equilibrium state with the lid closed. Each of the openable sections was then opened and closed every 5 minutes for 2 hours to simulate use in a retail environment. During the tests the power consumption was monitored and/or observations were recorded of condensation on the further sections.

Tests 1 to 8

The effect of the amount of area covered by the further panel was investigated using the VT300 freezer modified with further panels of different size such that the gaps between the panels and the side walls (A and B as described above) were varied. The height (H) distance was kept constant at 10 mm in these experiments. The results are shown in Table 1.

TABLE 1

| Test # | A (mm) | B (mm) | % Opening covered by further panel | Energy Consumption (kWh/24 h) | Energy Savings (%) | Condensation (Y or N) |
|---|---|---|---|---|---|---|
| 1 | N/A | N/A | Unmodified | 1.748 | 0 | N/A |
| 2 | 0 | 0 | 100 | 1.311 | 25 | Y |
| 3 | 0 | 15 | 94 | 1.295 | 26 | Y |
| 4 | 10 | 15 | 92 | 1.273 | 27 | Y |
| 5 | 20 | 15 | 90 | 1.299 | 26 | Y |
| 6 | 30 | 15 | 89 | 1.301 | 26 | Y |
| 7 | 40 | 15 | 87 | 1.297 | 26 | N |
| 8 | 50 | 15 | 85 | 1.308 | 25 | N |

The data in table 1 show that all of the tests using the lid modified with the further panel had much better energy efficiency than the unmodified cabinet. For test 2, where the further panel covered the entire opening, severe condensation formed on a large surface area of the further panel sections. This condensation was decreased in test 3 and progressively reduced as the amount of opening covered by the further panel was reduced. In tests 7 and 8, where less than 89% of the opening was covered, the condensation was eliminated without substantially affecting the energy efficiency gain afforded by the presence of the further panel.

Test 9

The effect of the positioning of the further panel relative to the evaporator was investigated using the VT300 freezer modified with further panels wherein the height (H) distance was varied. In these experiments there was no gap between the further panels and the sidewalls (i.e. both A and B were zero). The results are shown in Table 2.

TABLE 2

| Test # | H (mm) | Energy Consumption (kWh/24 h) | Energy Savings (%) | Condensation (Y or N) |
|---|---|---|---|---|
| 1 | Unmodified | 1.748 | 0 | N/A |
| 2 | 10 | 1.311 | 25 | Y |
| 9 | −25 | 1.375 | 21 | N |

The data in table 2 show that when the further panel is placed below the top of the evaporator, the energy benefits are reduced. This is believed to be because the air in the quiescent region is cooled too much. No condensation was observed in test 9 as the moisture in the quiescent region was able to migrate directly to the evaporator.

Tests 10 to 15

The effect of the positioning of the further panel relative to the evaporator was investigated using the freezer with the roll-bond evaporator and modified with further panels wherein the height (H) distance was varied. In these experiments the gaps with the sidewalls (A) and (B) were maintained at 50 mm and 15 mm respectively. The results are shown in Table 3.

TABLE 3

| Test # | H (mm) | Energy Consumption (kWh/24 h) | Energy Savings (%) |
|---|---|---|---|
| 10 | Unmodified | 1.61 | 0 |
| 11 | 23 | 1.39 | 14 |
| 12 | 53 | 1.353 | 16 |
| 13 | 73 | 1.334 | 17 |
| 14 | 93 | 1.331 | 17 |
| 15 | 112 | 1.353 | 16 |

The data in table 3 clearly show that increasing the height distance (H) improved the efficiency of the freezer, except that increasing the height above about 80 mm gave no further benefit and above 100 mm the benefit even appeared to decrease slightly.

The invention claimed is:

1. A freezer cabinet for storing frozen confectionery products, the freezer cabinet comprising:

a chamber having an opening substantially sealed by an upper surface panel; and a further panel inside the chamber being spaced away from the upper surface panel and substantially parallel to the upper surface panel in at least one direction and creating a quiescent region between the upper surface panel and further panel wherein the quiescent region is in gaseous communication with the air in the chamber when both the upper and further panels are in a closed configuration;

wherein:

at least part of the upper surface panel and further panel is transparent such that at least part of the inside of the chamber is visible through the upper surface panel and further panel;

the upper surface panel comprises at least one slideably openable section;

the further panel comprises at least one slideably openable section; and the chamber comprises a side wall and a coolant evaporator mounted in and/or on the side wall; and the height distance (H) between the further panel, measured from the lowest face of the further panel facing the chamber, and the highest part of the evaporator is at least 5 mm and less than 100 mm, the cabinet not comprising a forced air cooling system.

2. The freezer cabinet as claimed in claim 1 wherein the height distance (H) is at least 7 mm.

3. The freezer cabinet as claimed in claim 2 wherein the height distance (H) is between 8 and 80 mm.

4. The freezer cabinet as claimed in claim 1 wherein the further panel covers less than 95% of the surface area of the opening.

5. The freezer cabinet as claimed in claim 4 wherein the further panel covers between 70 and 88% of the surface area of the opening.

6. The freezer cabinet as claimed in claim 1 wherein the upper surface panel and the further panel both comprise two slideably openable sections.

7. The freezer cabinet as claimed in claim 1 wherein the slideably openable section in the upper surface panel is aligned with the corresponding slideably openable section in the further panel such that when moved parallel to one another an opening is created of about the same surface area.

8. The freezer cabinet as claimed in claim 7 wherein the slideably openable section in the upper surface panel is attached to the corresponding slideably openable section in the further panel such that the slideably openable section in the further panel remains unmoved relative to the slideably openable section in the upper surface panel when the latter is opened and closed.

9. A method of providing a freezer cabinet according to claim 1, the method comprising:

providing an existing freezer cabinet comprising the chamber having the opening substantially sealed by the upper surface panel; and installing the further panel inside the chamber in an arrangement substantially parallel to but spaced away from the upper surface panel to create the quiescent region.

* * * * *